United States Patent [19]

Lo

[11] Patent Number: 5,004,995

[45] Date of Patent: Apr. 2, 1991

[54] FUSE ASSEMBLY FOR CAR

[76] Inventor: Ying C. Lo, No. 46, Lane 130, Ming-Tzwu Rd., Miau-Li, Taiwan

[21] Appl. No.: 497,284

[22] Filed: Mar. 22, 1990

[51] Int. Cl.[5] ..... H01H 85/32

[52] U.S. Cl. ..... 337/266; 337/242

[58] Field of Search ..... 337/266, 242

[56] References Cited

U.S. PATENT DOCUMENTS 4,499,447 2/1985 Greenberg ..... 337/266

4,695,815 9/1987 Hwang ..... 337/266

*Primary Examiner*—Harold Broome

*Attorney, Agent, or Firm*—Browdy and Neimark

[57] ABSTRACT

A fuse assembly for a car incorporates therein an indicating bulb having two electrodes in order that the user can easily know that the fuse therein is blasted. The assembly includes a crosssectionally generally rectangular housing having a central room and two side rooms, two conducting plates received in the rooms, and a fuse connected between and integrally formed with the plates, in which the housing and the plates clamp therebetween the electrodes in order to position the bulb in the central room.

3 Claims, 1 Drawing Sheet

FUSE ASSEMBLY FOR CAR

BACKGROUND OF THE INVENTION

The present invention relates to a fuse, and more particularly to a fuse assembly for a car.

The conventional fuse assembly for a car includes a transparent tube, two metallic covering sleeves mounted on two ends of the tube and a fuse received in the tube and connected to the covering sleeves. Such fuse assembly is getting used fewer and fewer now since it cannot be conveniently put into practice and/or use.

In order to overcome the above shortcoming, there has been developed a fuse assembly 10 which as shown in FIG. 1 includes a hollow insulating housing 11 having a receiving room 12, two conducting plates 13 parallelly juxtaposed in the receiving room 12 and each of which has an inserting end 14 protruding beyond the housing 11, and a fuse 15 mounted between and integrally formed with the conducting plates 13. In use, the inserting ends 114 of the conducting plates 13 are inserted into a fuse assembly socket 20 having a plurality of socket slots 21 and electrically connected to various circuit system of the car. Such structure is advantageous in that the user can conveniently use or replace the fuse assembly 10 and the fuse assembly socket 20 can insert thereon a relatively great number of the fuse assembliess 10.

Nevertheless, either one of the above described two types of fuse assemblies is disadvantageous in that it is difficult for the user to determine whether a particular fuse assembly is out of order since a car normally has about 10~20 fuse assemblies grouped together.

It is therefore tried by the Applicant to deal with the shortcomings encounted by the prior art.

SUMMARY OF THE INVENTION

It is therefore an object of the present invention to provide a fuse assembly enabling the user to readily determine whether it is out of order.

According to the present invention, a fuse assembly for a car includes a crossectionally generally rectangular hollow insulating housing having an open bottom, a central receiving room, two side rooms and a top having two holes, two conducting plates respectively received in the side rooms and each of which includes a first end inserted in one of the top holes and a second opposite end protruding beyond the open bottom, a fuse having two ends thereof respectively connected to and integrally formed with the conducting plates, and an indicating bulb having two diametrically disposed electrodes respectively generally positioned in the side rooms, in which the top and the first ends of the conducting plates clamp therebetween the two electrodes in order to generally position the indicating bulb in the central room.

The present invention may best be understood through the following description with reference to the accompanying drawings, in which:

DETAILED DESCRIPTION OF THE PREFERRED EMBODIMENT

Figure 1:
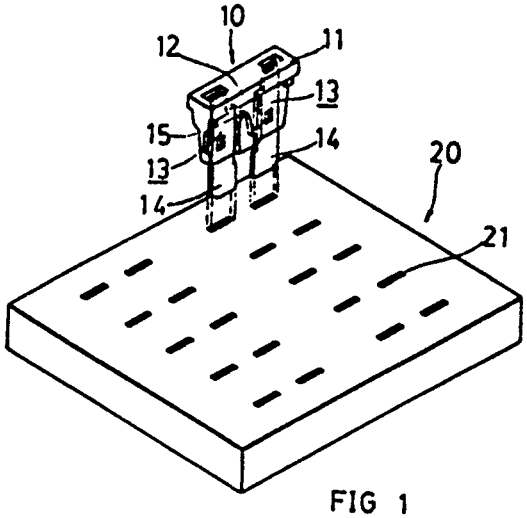
FIG 1 PRIOR ART
FIG. 1 is a perspective view showing a fuse assembly according to the prior art and a fuse assembly socket therefor.
Figure 2:
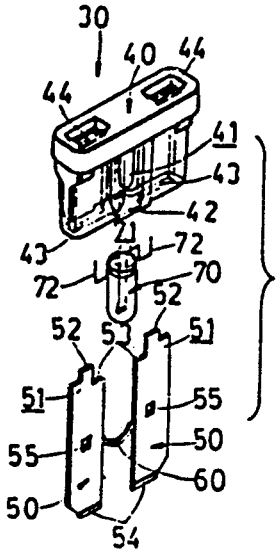
FIG. 2 is an exploded view showing a preferred embodiment of a fuse assembly according to the present invention.
Figure 3:
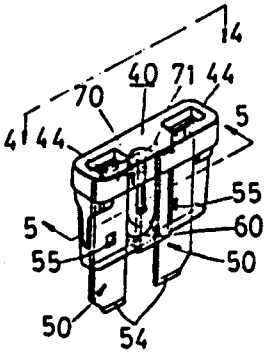
FIG. 3 is a perspective view showing a fuse assembly in FIG. 2.
Figure 4:
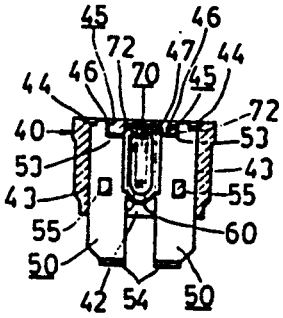
FIG. 4 is a sectional view taken along line 4—4 in FIG. 3.
Figure 5:
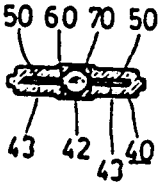
FIG. 5 is a sectional view taken along line 5—5 in FIG. 3.

Referring now to FIGS. 2-5, a fuse assembly 30 according to the present invention includes a hollow insulating housing 40, two conducting plates 50, a fuse 60 and an indicating bulb 70. Housing 40 is made of a transparent or translucent plastic material and includes an open bottom, a receiving portion 41 having a central room 42 and two side rooms 43 communicating with central room 42, and a top having two through holes 44 respectively communicating with side rooms 43 and two downward engaging pieces 45 which respectively include two diametrically opposite angulate surfaces 46 and form therebetween together with two side walls of housing 40 a receiving space 47.

Each of conducting plates 50 is made of metal having a good conductivity, e.g. the aluminum and received in one respective side room 43 and includes a first end 51 having a tip 52 inserted in one respective hole 44 and a cornered surface 53 complementary to one respective angulate surface 46, a second opposite end 54 protruding beyond the open bottom, and an intermediate through hole 55 by which a high freguency wave can be used to meltingly connect together two side walls of housing 40 to parallelly juxtaposed conducting plates 50 in housing 40.

Fuse 60 is arcuate to unharmedly allow a slight displacement of either conducting plate 50 and generally received in central room 42 and has two ends thereof respectively connected to and integrally formed with conducting plates 50 to have a simple manufacture so that fuse 60 and conducting plates 50 can be easily assembled in housing 40.

Indicating bulb 70 having an internal resistance larger than that of any other one of the electrical devices used in the car includes two diametrically disposed electrodes 71 respectively generally positioned in side rooms 43 and having two U-shaped portions 72 an angled portion of each of which is firmly clamped between one respective cornered surface 53 and one respective angulate surface 46 to connect fuse 60 and indicating bulb 70 is parallel. Indicating bulb 70 is received in central room 42 and receiving space 47 and positioned between the housing top and fuse 60.

The bulb 70 has a base portion which has "U" shaped electrodes 72. The bulb also has a tip portion on the opposite end from its base portion. The bulb is placed in the housing 40 with its base closer to the upper surface than its tip.

Upon assembling, indicating bulb 70 is inserted in receiving portion 41 before conducting plates 50 and fuse 60 are inserted therein to properly fix and position indicating bulb 70 therein. Finally, a high freguency wave is used to meltingly connect together two side walls of housing 40 by the provision of through holes 55 of conducting plates 50 to suitably secure conducting plates 50, fuse 60 and indicating bulb 70 in receiving portion 41.

Figure 6:
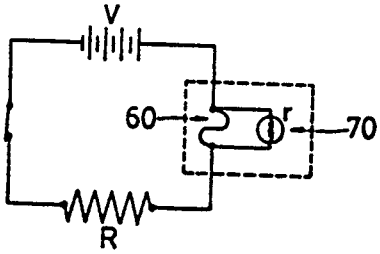
FIG. 6 is a circuit diagram showing a fuse assembly in FIG. 2 in a normal operation.
Figure 7:
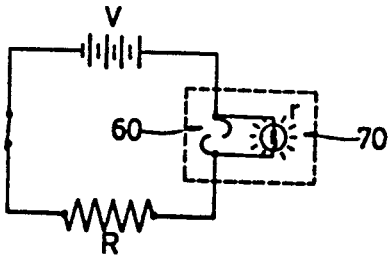
FIG. 7 is a circuit diagram showing a fuse assembly in FIG. 2 being out of order.

The conventional fuse assembly socket can be used for the present fuse assembly 30 the operation principle of which is as follows:

As shown in FIG. 6 wherein V represents the potential of the car battery, R stands for the internal resistance of a particular electrical device in the car and r represents the internal resistance of indicating bulb 70, if the present fuse assembly 30 is in order, the electrical current will flow through fuse 60 but not indicating bulb 70 since r, e.g. being 100 ohms is relatively large and connected with fuse 60 in parallel. As shown in FIG. 7, if fuse 60 is blasted, the electrical current can only flow through indicating bulb 70 and is much smaller than the rated current in order not only to protect the electrical device kept unactuated from being damaged but also to light up indicating bulb 70 so that the relevant person can readily know which electrical device or fuse assembly 30 is out of order.

What I claim is:

1. A fuse assembly for a car comprising:

a cross-sectionally generally rectangular hollow insulating housing including an open bottom, a central receiving room, two side receiving rooms both communicating with said central receiving room, said and a top 44, said top having two diametrically opposite angulate surfaces 46, and two through holes respectively communicating with said two side rooms;

two conducting plates respectively received in said two side rooms, respectively having two cornered surfaces 53 respectively complementary to said angulate surfaces, and each of which includes a first end inserted in one of said two top holes 44 and a second opposite end protruding beyond said open bottom to be adapted to be inserted to a fuse assembly socket for said car; and a fuse positioned in said central room and having two ends thereof respectively connected to and integrally formed with said two conducting plates, in which:

said fuse assembly further includes an indicating bulb generally positioned in said central room and between said top and said fuse 60 and having two diametrically disposed electrodes 72 respectively generally positioned in said two side rooms and respectively having two U-shaped portions having two angled portions respectively firmly clamped between said cornered surfaces 53 and said angulate surface 46, and said top and said first ends of said two conducting plates clamp therebetween said two electrodes in order to generally position said indicating bulb in said central room.

2. A fuse assembly in accordance with claim 1, wherein said housing in transparent.

3. A fuse assembly in accordance with claim 1, wherein said bulb is generally positioned with its base closer to the top of said housing than its tip.

* * * * *